US006807714B2

(12) United States Patent
O'Young et al.

(10) Patent No.: US 6,807,714 B2
(45) Date of Patent: Oct. 26, 2004

(54) CABLE TIE HAVING STEPPED DOWN STRAP BODY TEETH

(75) Inventors: Jason O'Young, Mokena, IL (US); Jonathan DeMik, Schererville, IN (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 10/092,316

(22) Filed: Mar. 4, 2002

(65) Prior Publication Data

US 2003/0163904 A1 Sep. 4, 2003

(51) Int. Cl.[7] ..... B65D 63/10
(52) U.S. Cl. ..... 24/16 PB
(58) Field of Search ..... 24/16 R, 16 PB, 24/30.5 P, 17 A, 17 AP; 248/74.3

(56) References Cited

U.S. PATENT DOCUMENTS

| | | | | |
|---|---|---|---|---|
| 2,977,145 A | | 3/1961 | Rifkin | |
| 3,463,427 A | * | 8/1969 | Fisher | 248/68.1 |
| 3,590,442 A | * | 7/1971 | Geisinger | 24/16 PB |
| 3,660,869 A | | 5/1972 | Caveney et al. | |
| 3,717,906 A | * | 2/1973 | Wells | 24/16 PB |
| 3,872,547 A | | 3/1975 | Caveney et al. | |
| 3,906,593 A | | 9/1975 | Caveney et al. | |
| 3,949,449 A | | 4/1976 | Caveney et al. | |
| 3,965,538 A | | 6/1976 | Caveney et al. | |
| 4,092,765 A | | 6/1978 | Joyce | |
| 4,214,349 A | * | 7/1980 | Munch | 24/16 PB |
| 4,236,280 A | * | 12/1980 | Kreiseder | 24/16 PB |
| 5,146,654 A | | 9/1992 | Caveney et al. | |
| 5,159,728 A | * | 11/1992 | Bingold | 24/16 PB |
| 5,267,373 A | | 12/1993 | Chisek | |
| 5,295,285 A | | 3/1994 | Shely | |
| 5,517,727 A | | 5/1996 | Bernard et al. | |
| 5,584,452 A | * | 12/1996 | Koike | 248/74.3 |
| 6,279,203 B1 | | 8/2001 | Hundley et al. | |

FOREIGN PATENT DOCUMENTS

| | | | | |
|---|---|---|---|---|
| FR | 2136843 | | 12/1972 | |
| GB | 2188362 A | * | 9/1987 | F16B/2/08 |

* cited by examiner

*Primary Examiner*—James R. Brittain
(74) *Attorney, Agent, or Firm*—Robert A. McCann; Christopher S. Clancy

(57) ABSTRACT

A cable tie having stepped down strap body teeth is disclosed. The cable tie includes a strap body having a first end and a second end opposite the first end, a locking head secured to the first end of the strap body, and a plurality of walls on the locking head forming a strap body accepting channel. The strap body includes a first group of teeth having a first predetermined depth and a second group of teeth having a second predetermined depth. The first depth is greater than the second depth. A method of making a cable tie is also disclosed.

11 Claims, 11 Drawing Sheets

CABLE TIE HAVING STEPPED DOWN STRAP BODY TEETH

BACKGROUND OF THE INVENTION

The present invention is directed to a one-piece cable tie, and more particularly, to a one-piece cable tie having stepped down strap body teeth to improve engagement between the locking wedge and the strap body at small bundle diameters.

Cable ties are well known and generally include an elongated strap body integrally formed with a head having a strap body passageway which includes a strap body locking mechanism for securing the strap body around a bundle of wires or cables. Typically, cable tie strap body teeth have their peaks even with or slightly below the top surface of the side rails. As shown in FIG. 4, in prior art cable ties this height remains the same throughout the length of the cable tie strap body.

Due to the orientation of the locking wedge within the head and the natural tendency for the strap body to straighten, the strap body teeth push against the locking wedge when the cable tie is installed, especially when the cable tie reaches smaller bundle diameters. During rapid cable tie threading, the strap body teeth exert excessive force on the first tooth of the locking wedge. As a result, the first tooth becomes deformed and elongated. A strap body tooth adjacent the strap body tooth contacting the first tooth of the locking wedge may push the locking wedge out of engagement before the elongated wedge tooth can drop into engagement with the strap body teeth. This disengagement effect is more pronounced for smaller bundle diameters, such as one inch or less.

It would be desirable to provide a cable tie having two or more cable tie strap body teeth sections of various depths to improve locking wedge engagement on small bundle applications.

It would also be desirable to provide a cable tie having a step down in strap body teeth depth to increase the distance between the wedge ramp of the locking wedge and the strap body teeth peaks.

It would further be desirable to provide a cable tie having stepped down strap body teeth to provide additional spacing for an elongated locking wedge tooth to pivot down into engagement with the strap body teeth.

SUMMARY OF THE INVENTION

The invention includes a cable tie having stepped down strap body teeth. The cable tie comprises a strap body having a first end and a second end opposite the first end, a locking head secured to the first end of the strap body, and a plurality of walls on the locking head forming a strap body accepting channel. The strap body includes a first group of teeth having a first predetermined depth and a second group of teeth having a second predetermined depth. The depth of the first group of teeth is between 0.001 and 0.007 inches greater than the depth of the second group of teeth.

Preferably, the depth of the first group of teeth is 0.003 inches greater than the depth of the second group of teeth.

Preferably, the first group of teeth is adjacent the first end of the strap body.

DETAILED DESCRIPTION OF PREFERRED EMBODIMENTS

The illustrated embodiment of the invention is directed to a one-piece cable tie having stepped down strap body teeth to improve engagement between the locking wedge and the strap body at small diameters.

Figures 1, 2:
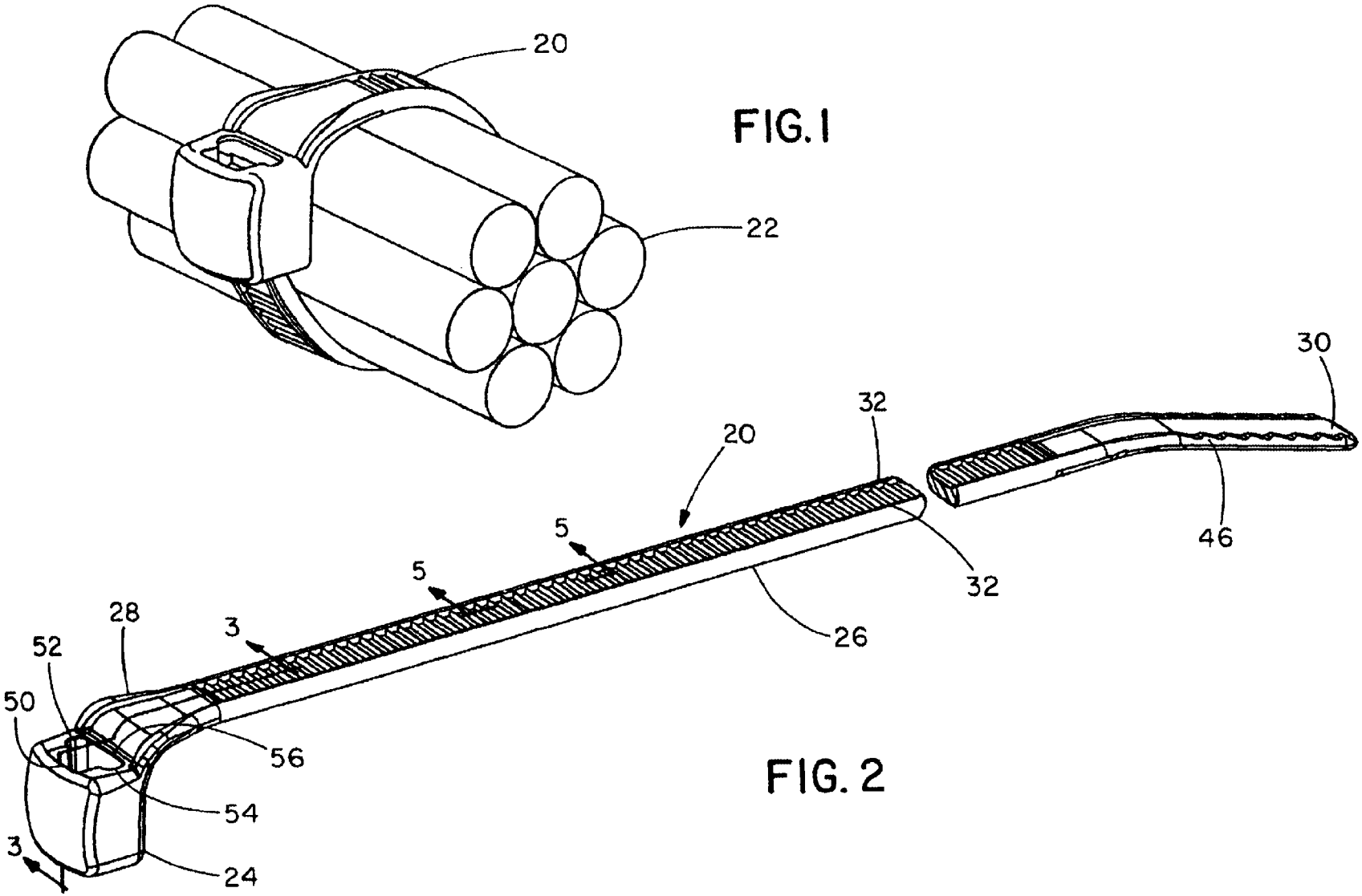
FIG. 1 shows a perspective view of a cable tie of the present invention shown securing a bundle of wires or cables.
FIG. 2 shows a perspective view of the cable tie of FIG. 1.

FIG. 1 shows a cable tie 20 as integrally molded from a suitable polymeric thermoplastic material such as 6.6 nylon securing a bundle of cables 22. It is likewise contemplated that the cable tie 20 be molded from other grades of nylon or non-nylon material. Preferably, the overall length of cable tie 20 is approximately 14 inches. It is likewise contemplated that the cable tie can be any desired length.

Figure 3:
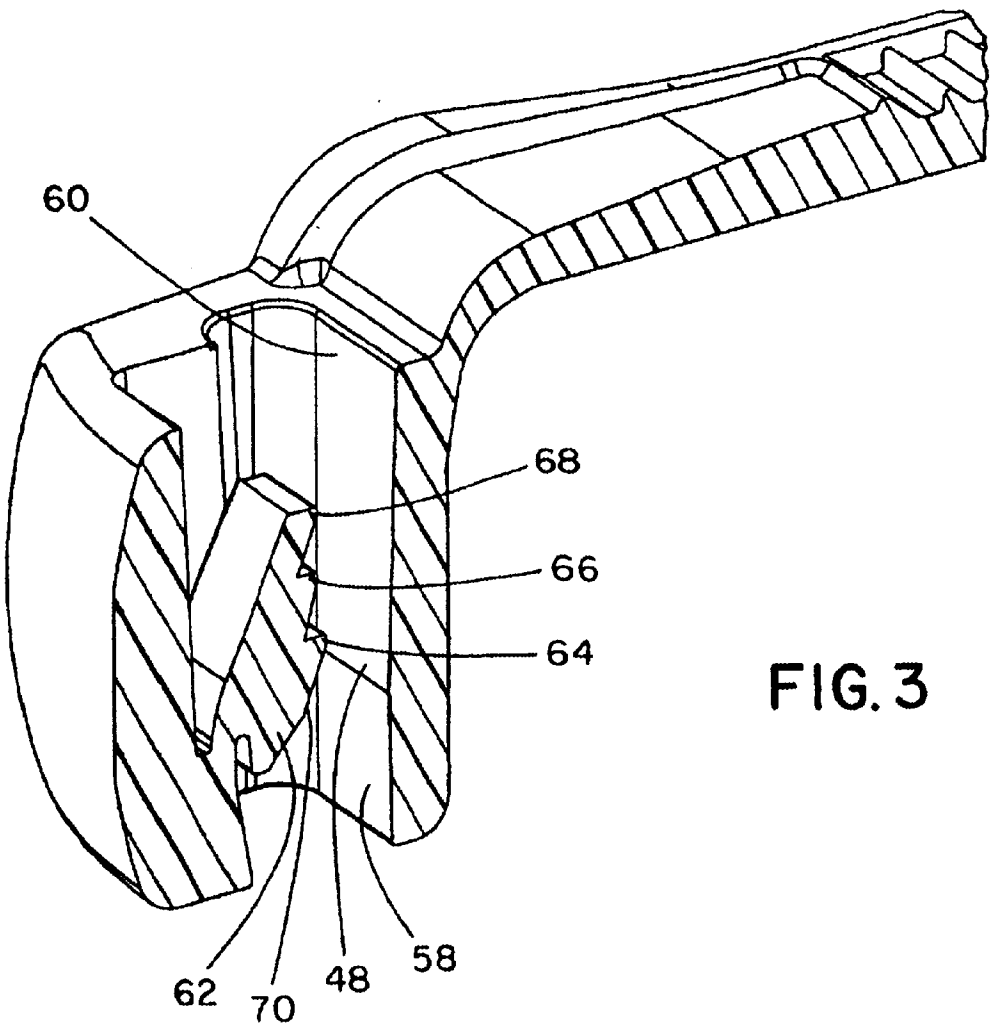
FIG. 3 shows an enlarged cross-sectional view of the cable tie of FIG. 1, taken along line 3—3 of FIG. 2 and looking in the direction of the arrows.
Figure 8:
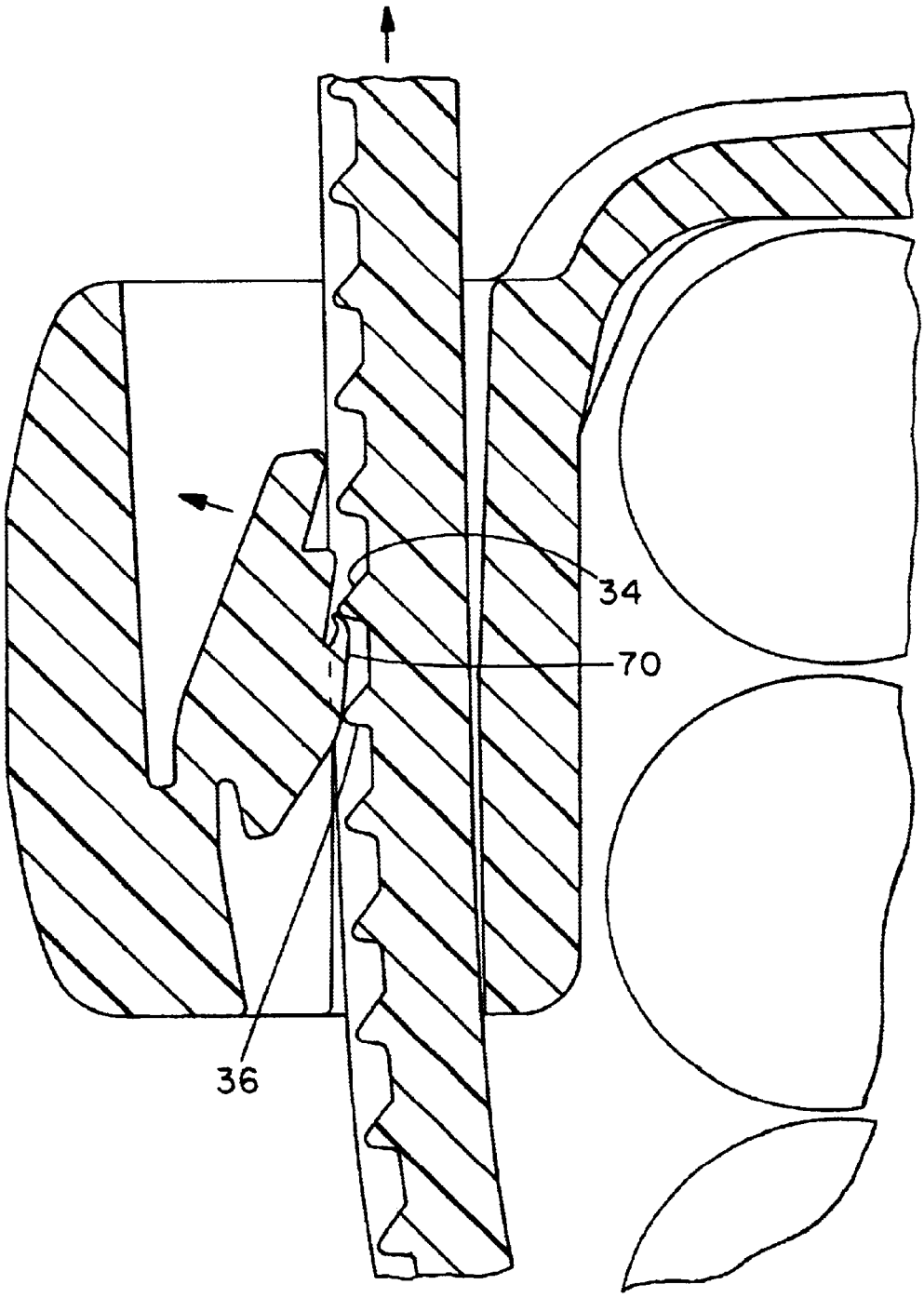
PRIOR ART FIG. 8
FIG. 8 shows an enlarged cross-sectional view of a cable tie according to the prior art during threading, with the locking wedge having an elongated first tooth and the adjacent strap tooth interfering with the wedge ramp.

FIG. 2 shows a perspective view of the cable tie 20, and FIG. 3 shows an enlarged cross-sectional view of the same. As can be seen therein, the cable tie 20 includes a head 24 and a strap body 26. The strap body 26 has a first end 28 and an angled second end 30 opposite the first end 28. The strap body 26 also has a pair of side rails 32 extending longitudinally the length of strap body 26, with a plurality of strap body teeth, such as 34, 36, 38, 40, 42 and 44 (see FIGS. 8, 10 and 11) extending between side rails 32. As shown in FIG. 2, serrations 46 are formed on the side rails 32 near the second end 30 of the strap body 26.

As best seen in FIG. 2 and enlarged FIG. 3, a strap body accepting channel 48 is defined in head 24 by an end wall 50, a first side wall 52, a second side wall 54 and an inner wall 56. The head 24 has an entry surface 58 where the strap body 26 is threaded through the head 24 and an exit surface 60 where the strap body 26 exits the head 24. As shown in FIG.

3, teeth are formed on the locking wedge 62. Preferably, the locking wedge 62 has a first tooth 64, a second tooth 66, a third tooth 68 and a wedge ramp 70. The wedge ramp 70 contacts the strap body teeth peaks of the cable tie 20 during insertion of the strap body 26 into the strap body accepting channel 48, as described in more detail below.

Figure 4:
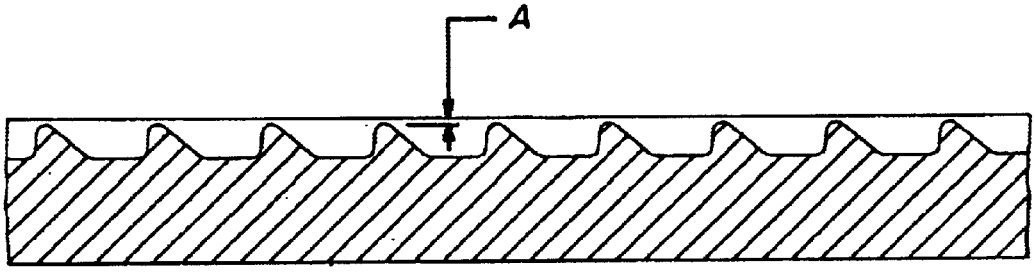
PRIOR ART FIG. 4
FIG. 4 shows an enlarged cross-sectional view of a cable tie according to the prior art.
Figure 5:
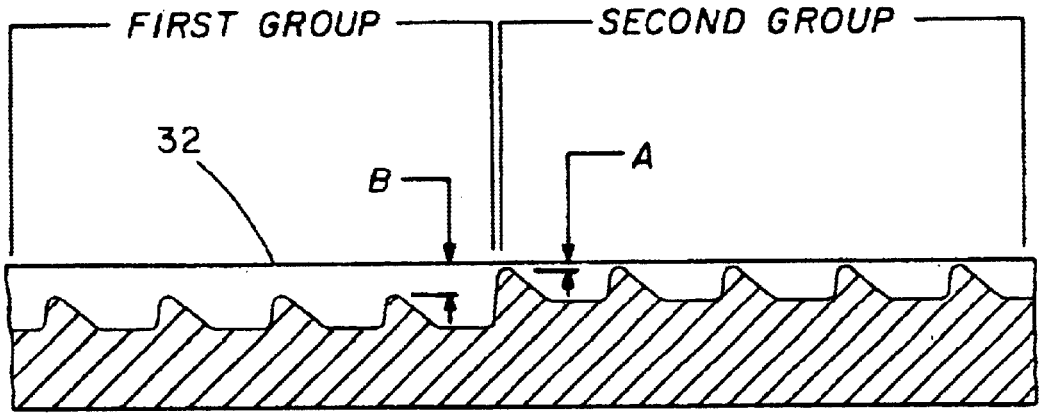
FIG. 5 shows an enlarged cross-sectional view of the cable tie of FIG. 1, taken along line 5—5 of FIG. 2 and looking in the direction of the arrows.

As can be seen in FIG. 4, cable tie strap body teeth typically have their peaks even with or slightly below the top surface of the side rails 32. In prior art cable ties, this height remains the same throughout the length of the cable tie body. Conversely, FIG. 5 shows a shift in strap tooth body geometry relative to the side rails 32. The majority of the cable tie 20 has the strap body teeth peaks at a depth A, and for the area closest to the head 24, the strap body teeth peaks are at a depth B. Preferably, depth A is 0.002 inches below the side rails 32, and depth B is 0.005 inches below the side rails 32. Thus, the strap body teeth peaks at depth B are offset from the strap body teeth peaks at depth A by 0.003 inches. Preferably, the strap body teeth peaks are at depth B for any length up to and including the three inches closest to the head 24.

Figure 6:
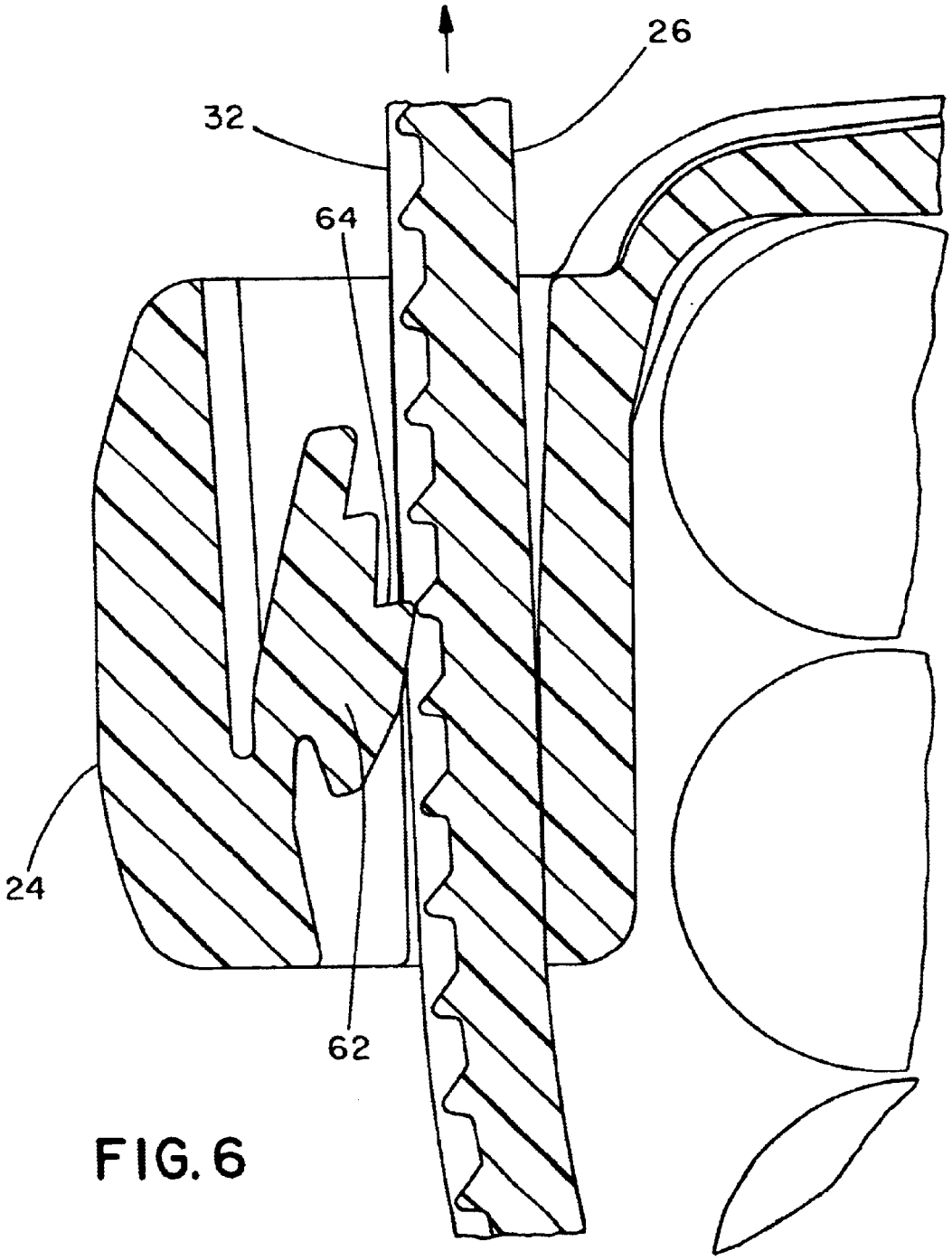
FIG. 6 shows an enlarged cross-sectional view of the cable tie of FIG. 1, before engagement of the locking wedge and the strap body teeth.
Figure 7:
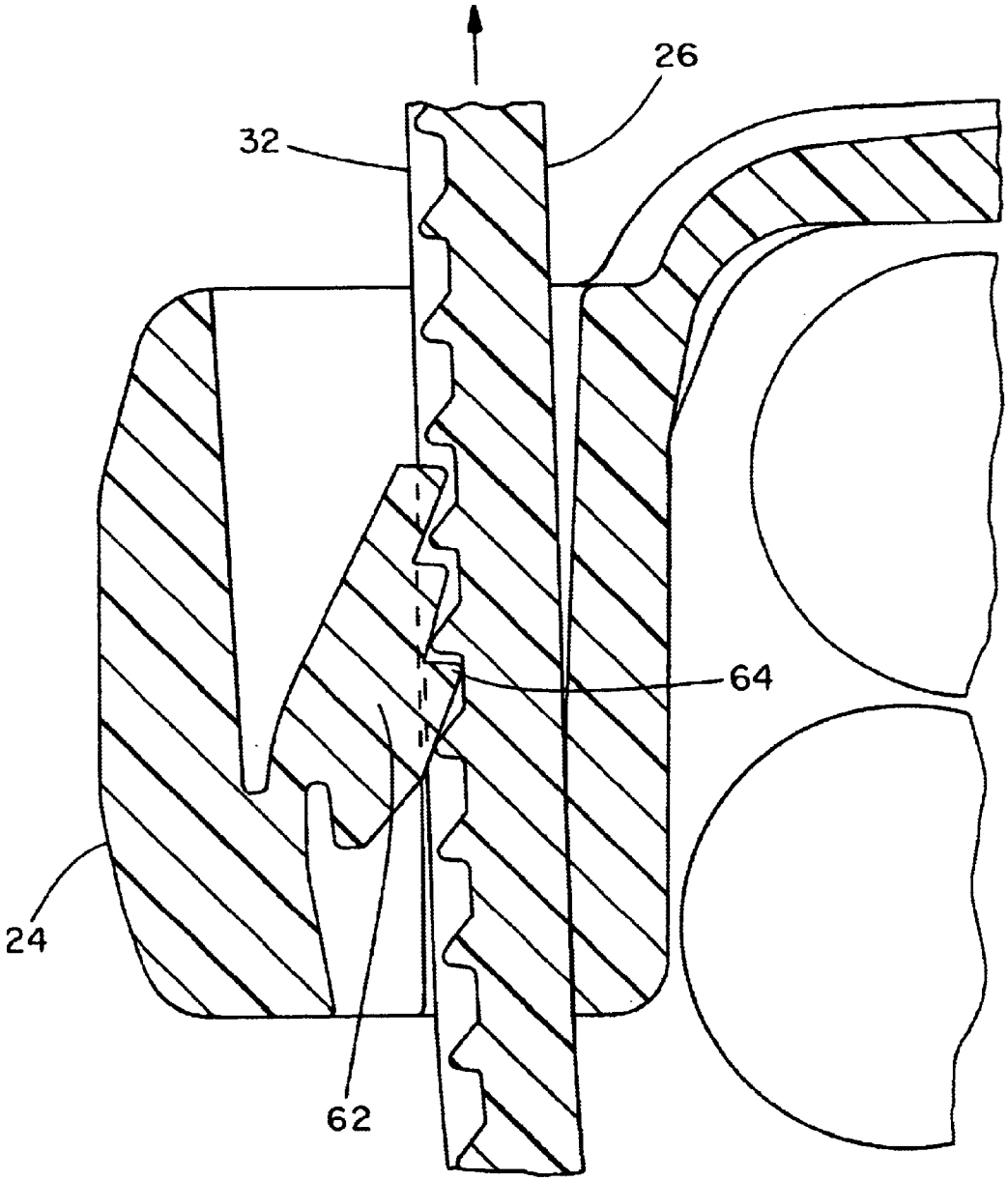
FIG. 7 shows an enlarged cross-sectional view of the cable tie of FIG. 1, after engagement of the locking wedge and the strap body teeth.

FIG. 6 shows the normal operation of cable tie 20 as the strap body 26 is threaded through the head 24 in the direction of the arrow, prior to the first tooth 64 of the locking wedge 62 becoming deformed and elongated. The first tooth 64 skips along the peaks of the strap body teeth until the strap body 26 is threaded to a desired bundle diameter. As shown in FIG. 7, after the desired diameter is reached, the first tooth 64 drops down and engages the cable tie strap body teeth. This engagement secures the locking wedge 62 within the strap body teeth.

Figure 9:
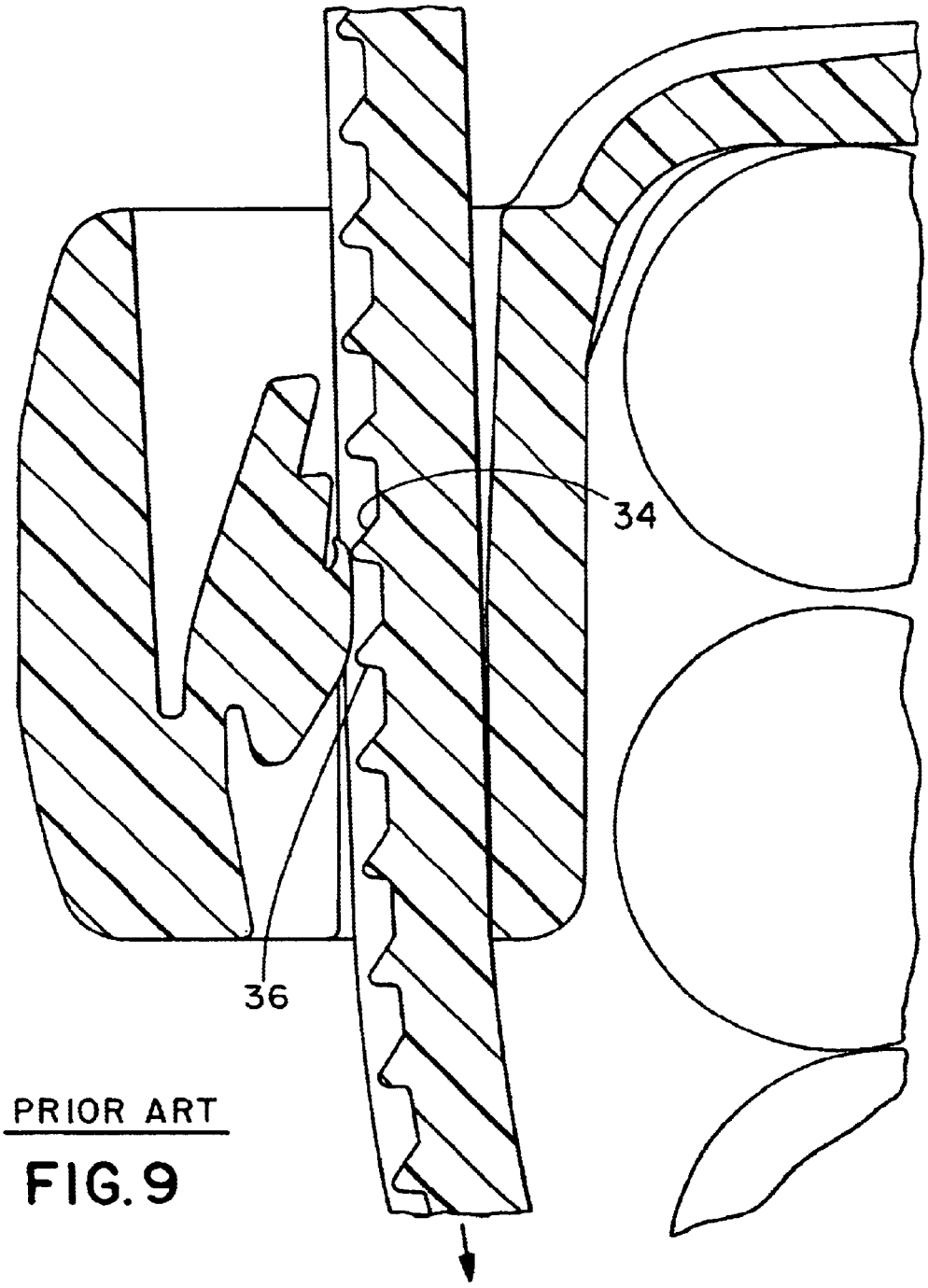
PRIOR ART FIG. 9
FIG. 9 shows an enlarged cross-sectional view of a cable tie according to the prior art during regression, with the locking wedge having an elongated first tooth.

However, due to the orientation of the locking wedge 62 within the head 24 and the natural tendency for the strap body to straighten, the strap body teeth push against the locking wedge 62 when the cable tie 20 is installed, especially when the cable tie 20 reaches smaller bundle diameters. During rapid cable tie threading, the strap body teeth exert excessive force on the first tooth 64 of the locking wedge 62. As a result, the first tooth 64 becomes deformed and elongated. As shown in the prior art of FIG. 8, the wedge ramp 70 engages strap body tooth 36 adjacent strap body tooth 34. Strap body tooth 36 may push the locking wedge 62 out of engagement before the elongated wedge tooth 64 can drop into engagement with strap body tooth 34. This disengagement effect is more pronounced for smaller bundle diameters, such as one inch or less. As can be seen in FIG. 9, when the prior art cable tie of FIG. 8 regresses in the direction of the arrow, the elongated locking wedge tooth 64 may skip along the strap body teeth resulting in inadequate engagement.

Figure 10:
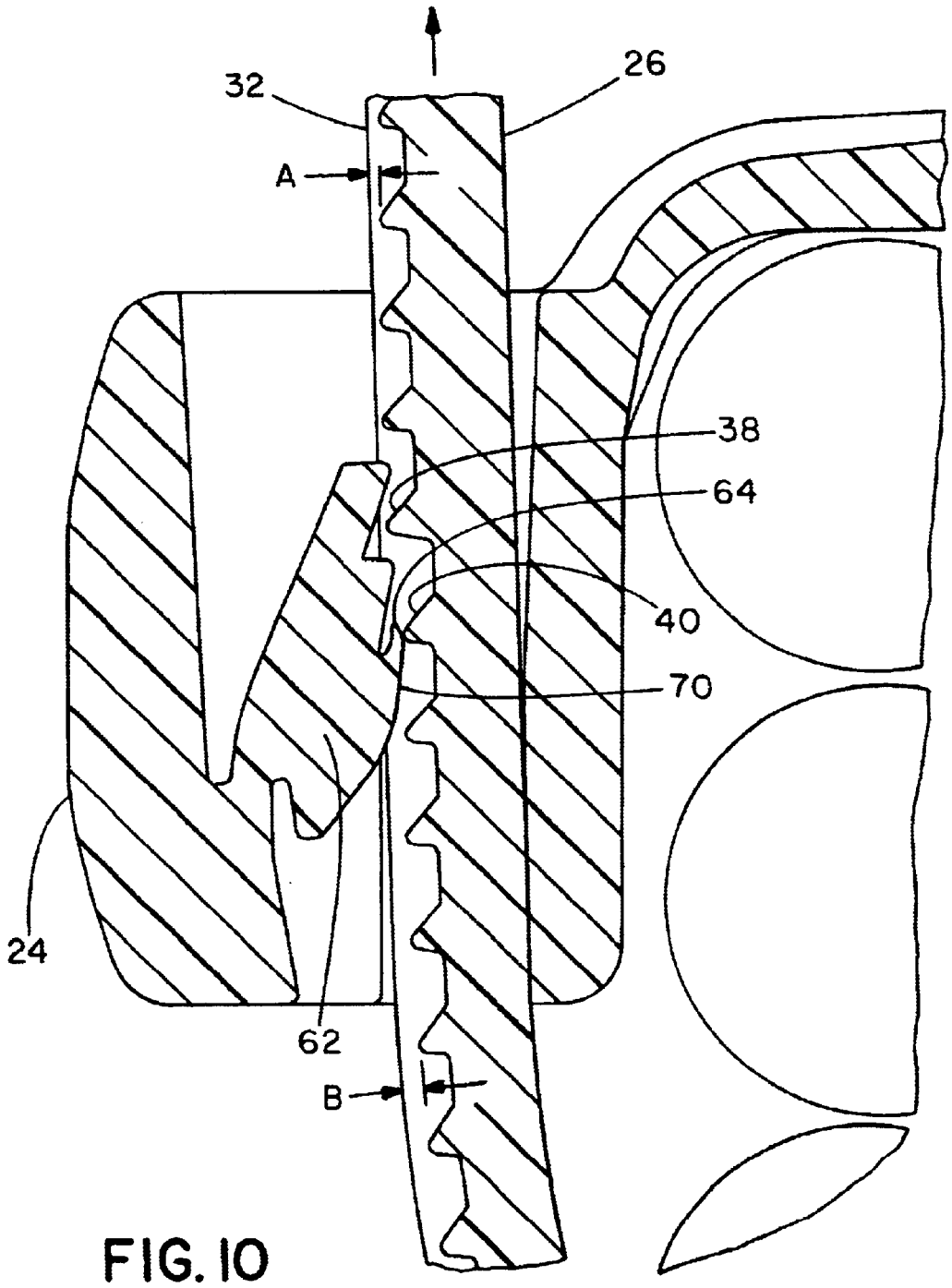
FIG. 10 shows an enlarged cross-sectional view of the cable tie of FIG. 1, prior to engagement of the locking wedge and the strap body teeth.
Figure 11:
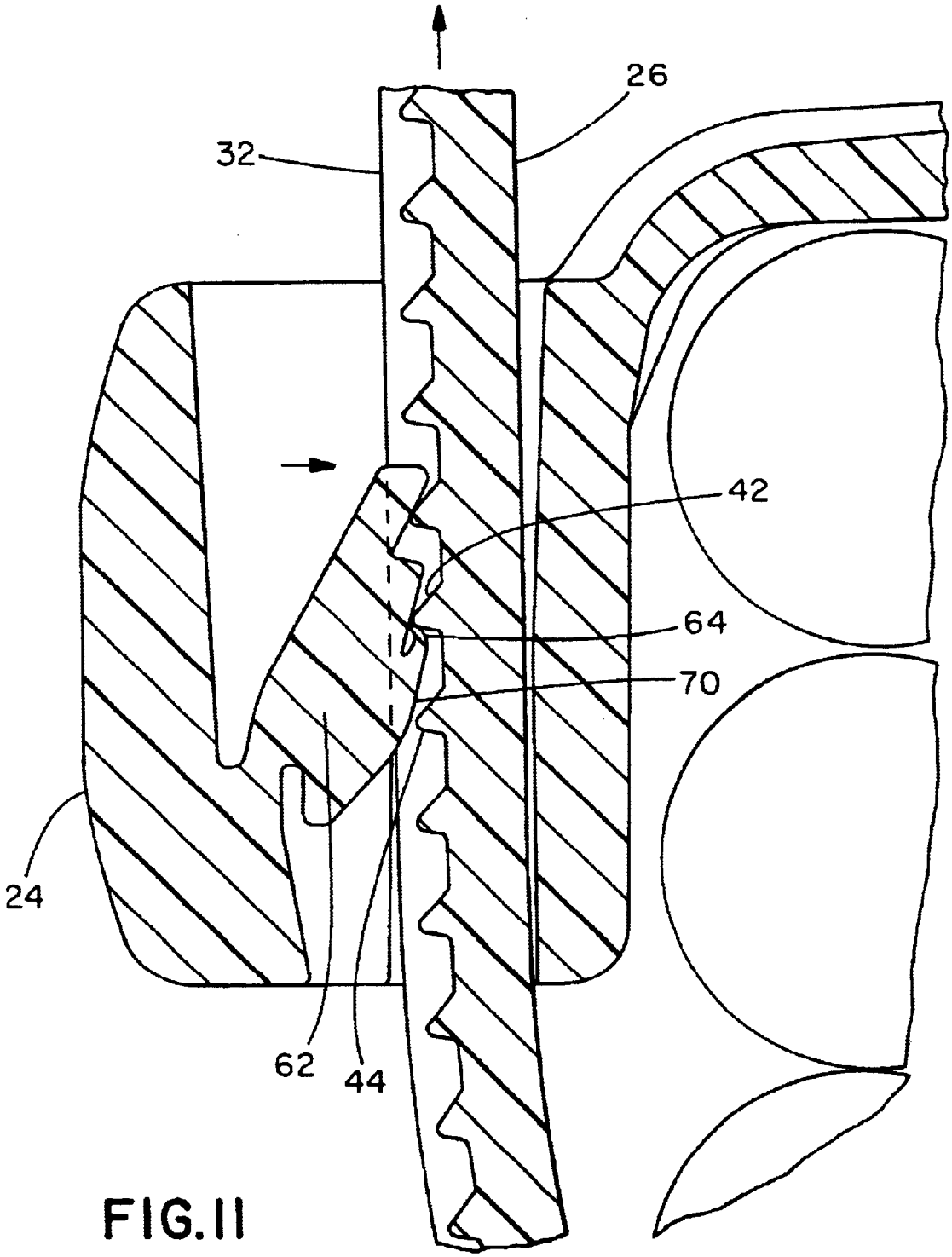
FIG. 11 shows an enlarged cross-sectional view of the cable tie of FIG. 1, after engagement of the locking wedge and the strap body teeth.

As shown in the preferred embodiment of FIG. 10, during threading of the strap body 26 in the direction of the arrow, the elongated locking wedge tooth 64 contacts the peak of strap body tooth 38 at depth A, and then shifts or steps down to contact the peak of strap body tooth 40 at depth B as the cable tie 20 reaches a smaller bundle diameter. The step down in strap body teeth from depth A to depth B increases the distance between the wedge ramp 70 and the peaks of the strap body teeth. As shown in FIG. 11, this increased distance, or clearance, allows the locking wedge 62 to pivot further into engagement with strap body tooth 42 before contacting the peak of adjacent strap body tooth 44. After threading, the locking wedge 62 pivots downward into engagement with the cable tie strap body teeth.

Figure 12:
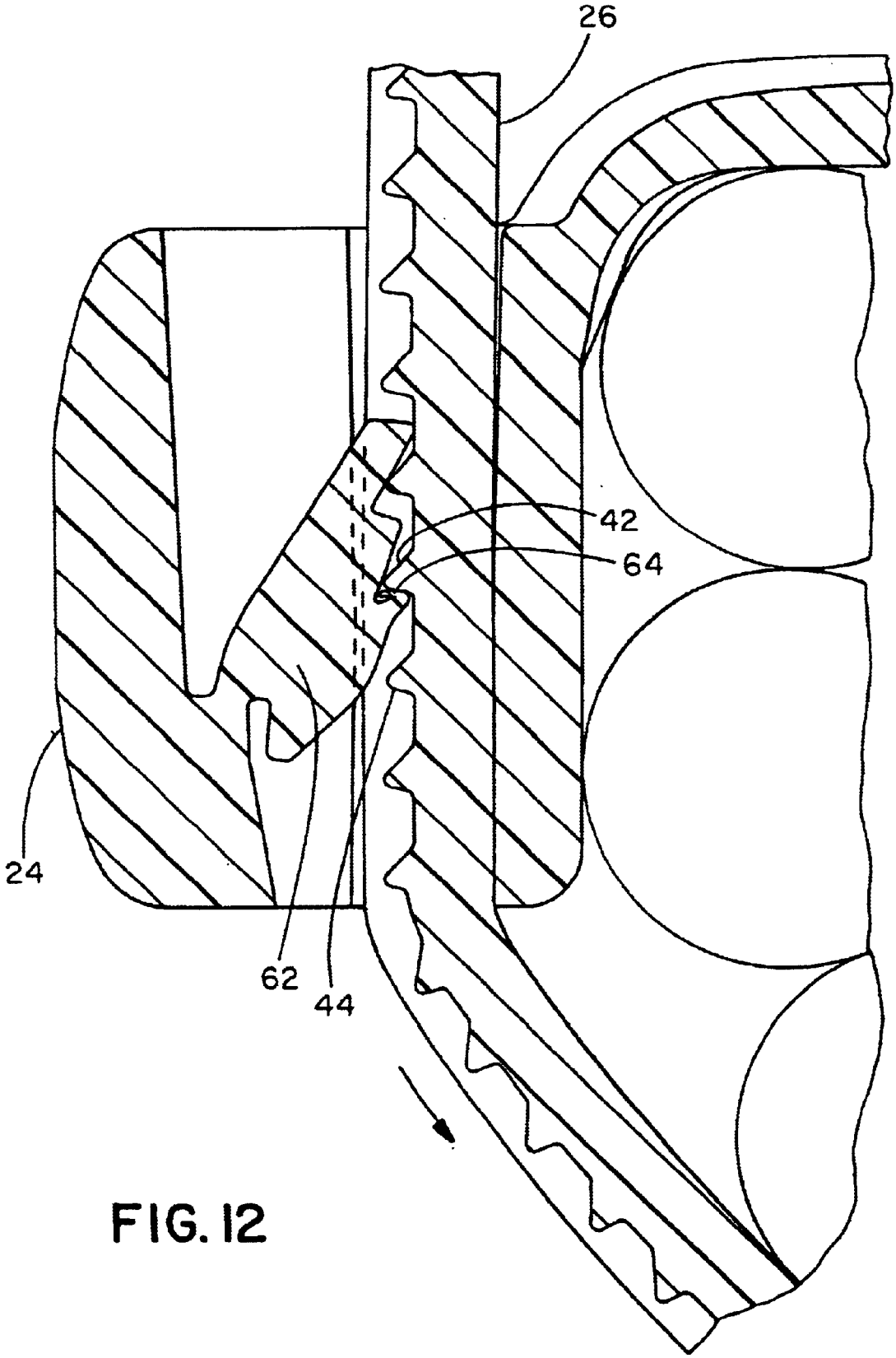
FIG. 12 shows an enlarged cross-sectional view of the cable tie of FIG. 1, after regression.
Figure 13:
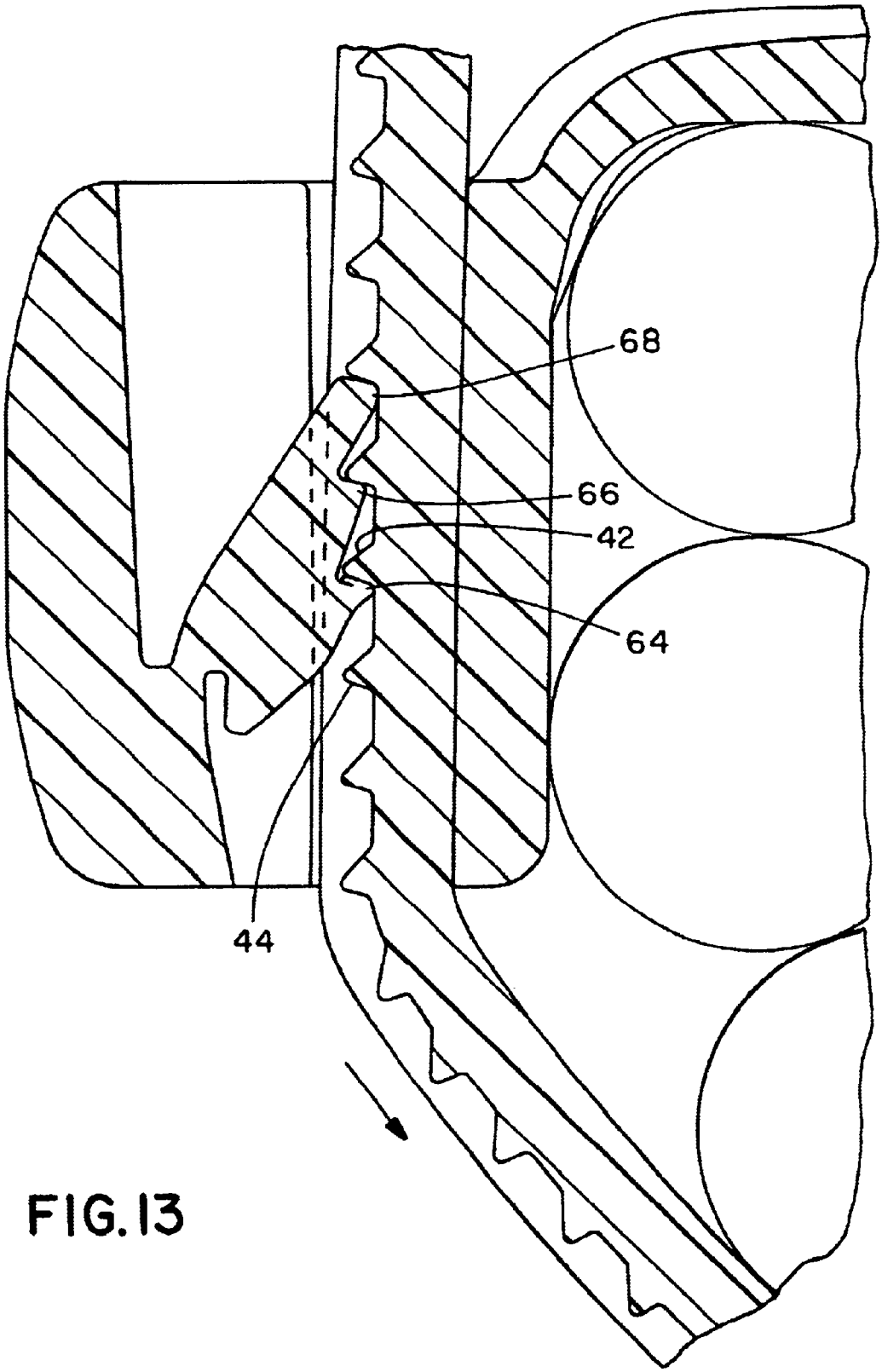
FIG. 13 shows an enlarged cross-sectional view of the cable tie of FIG. 1, after regression under maximum load.

As shown in FIG. 12, the elongated locking wedge tooth 64 is securely engaged within the cable tie strap body teeth after regression in the direction of the arrow. FIG. 13 shows the locking wedge 62 engaged within the strap body teeth under maximum load or tension. Under maximum tension, each of the first, second and third wedge teeth 64, 66, 68 engage the strap body teeth.

The disclosed invention provides a cable tie having stepped down strap body teeth. It should be noted that the above-described and illustrated embodiments and preferred embodiments of the invention are not an exhaustive listing of the forms such a cable tie in accordance with the invention might take; rather, they serve as exemplary and illustrative of embodiments of the invention as presently understood. By way of example, and without limitation, a cable tie having three or more cable tie strap body teeth sections of various depths is contemplated to be within the scope of the invention. Many other forms of the invention are believed to exist.

What is claimed is:

1. A cable tie, comprising:

a strap body having a first end and a second end opposite the first end, wherein the strap body includes a first group of teeth having peaks at a first predetermined height and a second group of teeth having peaks at a second predetermined height, the second predetermined height being greater than the first predetermined height, wherein the first group is closer than the second group to the first end;

a locking head secured to the first end of the strap body, wherein the locking head has a locking wedge including an engagement surface, whereby after the engagement surface is deformed and elongated, the difference between the first predetermined height and the second predetermined height allows the engagement surface to pivot down into engagement with both the first group of teeth and the second group of teeth to prevent retrograde movement of both the first group of teeth and the second group of teeth, depending on whether the engagement surface is engaged with the first group of teeth or the second group of teeth; and a plurality of walls on the locking head forming a strap body accepting channel.

2. The cable tie of claim 1 wherein the height of the second group of teeth is between 0.001 and 0.007 inches greater than the height of the first group of teeth.

3. The cable tie of claim 1 wherein the height of the second group of teeth is 0.003 inches greater than the height of the first group of teeth.

4. The cable tie of claim 1 wherein the first group of teeth is adjacent the first end of the strap body.

5. The cable tie of claim 1 wherein the strap body and the locking head are integrally molded of polymeric thermoplastic material.

6. The cable tie of claim 1 wherein the strap body and the locking head are integrally molded of nylon.

7. A method of making a cable tie comprising the step of:

molding a cable tie comprising a strap body having a first end and a second end opposite the first end, wherein the strap body includes a first group of teeth having peaks at a first predetermined height and a second group of teeth having peaks at a second predetermined height, the second predetermined height being greater than the first predetermined height, wherein the first group is closer than the second group to the first end, and a locking head secured to the first end of the strap body, wherein the locking head has a locking wedge including an engagement surface, whereby after the engagement surface is deformed and elongated, the difference between the first predetermined height and the second predetermined height allows the engagement surface to pivot down into engagement with both the first group of teeth and the second group of teeth to prevent retrograde movement of both the first group of teeth and the second group of teeth, depending on whether the engagement surface is engaged with the first group of teeth or the second group of teeth, and a plurality of walls on the locking head forming a strap body accepting channel.

8. The method of claim 7 wherein the height of the second group of teeth is between 0.001 and 0.007 inches greater than the height of the first group of teeth.

9. The method of claim 7 wherein the height of the second group of teeth is 0.003 inches greater than the height of the first group of teeth.

10. The method of claim 7 wherein the first group of teeth is adjacent the first end of the strap body.

11. A cable tie, comprising:

a strap body having a first end and a second end opposite the first end, and a pair of side rails having a height and extending longitudinally the length of the strap body, wherein the strap body includes a first group of teeth having peaks at a first predetermined height and a second group of teeth having peaks at a second predetermined height, the second predetermined height being greater than the first predetermined height, the first predetermined height and the second predetermined height being less than the height of the side rails, wherein the first group is closer than the second group to the first end;

a locking head secured to the first end of the strap body, wherein the locking head has a locking wedge including an engagement surface, whereby after the engagement surface is deformed and elongated, the difference between the first predetermined height and the second predetermined height allows the engagement surface to pivot down into engagement with the first group of teeth; and a plurality of walls on the locking head forming a strap body accepting channel.

* * * * *